US005139147A

United States Patent [19]

Sutherland

[11] Patent Number: 5,139,147

[45] Date of Patent: Aug. 18, 1992

[54] PACKAGE INCORPORATING FLANGED CONTAINERS

[75] Inventor: Robert L. Sutherland, Marietta, Ga.

[73] Assignee: The Mead Corporation, Dayton, Ohio

[21] Appl. No.: 745,138

[22] Filed: Aug. 12, 1991

[51] Int. Cl.[5] ..... B65D 65/00; B65D 5/26; B65D 5/24

[52] U.S. Cl. ..... 206/431; 229/186; 206/147

[58] Field of Search ..... 229/186; 206/147, 427, 206/431

[56] References Cited

U.S. PATENT DOCUMENTS

| | | | |
|---|---|---|---|
| 3,670,881 | 6/1972 | Dutcher | 206/45.34 |
| 3,675,764 | 7/1972 | Dutcher | 206/45.34 |
| 4,832,257 | 5/1989 | Wood | 206/427 X |

FOREIGN PATENT DOCUMENTS

| | | | |
|---|---|---|---|
| 0141631 | 7/1990 | European Pat. Off. . | |
| 2298489 | 8/1976 | France . | |
| 1523320 | 8/1978 | United Kingdom | 229/186 |
| 2207903 | 1/1991 | United Kingdom . | |

*Primary Examiner*—William I. Price
*Attorney, Agent, or Firm*—Thomas A. Boshinski

[57] ABSTRACT

A package includes one or more flanged cups, the cups being arranged and interconnected at their respective flanges to form an array. A paperboard cover having a polygonal main panel of an area generally corresponding to the area of the interconnected cup flanges is disposed over the array. A side panel is connected along an upper fold line to each side edge of the main panel, with each of the side panels projecting generally downwardly from the main panel. Each adjacent pair of side panels is foldably connected at their respective end edges through a pair of foldably interconnected web panels, the angle defined between each end edge of the side panels and the corresponding upper fold line being less than ninety degrees. Each of the web panel pairs are attached together in overlapping arrangement and disposed behind an associated one of the side panels, whereby the side panels are tapered inwardly with respect to the cups to secure the main panel to the cup array.

5 Claims, 2 Drawing Sheets

PACKAGE INCORPORATING FLANGED CONTAINERS

BACKGROUND OF THE INVENTION

The present invention relates to a package which incorporates at least one cup-like container having a top flange which extends outwardly from the cup. The package comprises the cups and an overlying paperboard cover.

Products such as yogurt are frequently packaged into thermoplastic cups. Each cup is provided with an outwardly projecting flange at its upper end, and the cup may be sealed by a metal foil, plastic film or other lid sealed over the cup to the flange. For sale as a unit, a group of cups may be arranged in an array, with the cup flanges interconnected to hold the cups together. Score lines or similar means may be provided so that the individual cups can be separated for single servings.

Flanged containers of this type may be incorporated into a package which includes a paperboard wrapper or cover. The paperboard protects the cups, particularly the sealing means for the cups, and provides an area on which advertising, product information and other printed material may be placed. Examples of different packages of this type for flanged containers may be seen in British Patent No. 2,207,903 showing a paperboard wrapper which extends completely around the cups, or in European Patent No. 0,141,631, showing a paperboard cover which is attached to the cup flanges, the cover having portions which extend at least partially downward along the cups.

Another package of this type is shown in U.S. Pat. No. 3,675,764. The interconnected cups are provided with a cover having downwardly projecting end and side walls. Corner flaps are used to interconnect adjacent end and side walls, with the corner flaps further including upper edges disposed near the top panel of the cover. When placed onto the cup array, the corner flaps of the cover contact the bottom surface of the cup flanges, thereby securing the cover to the cups.

To ensure that the corner flaps adequately engage the cup flanges, it is necessary to provide additional fold lines in the cover side walls. This detracts from the appearance of the carton, and adds further complexities to the packaging operation. In addition, the vertical orientation of the side and end walls provides a relatively large gap between the bottom edge of the panels and the side walls of the cups. This increases the likelihood of tearing or other damage to the carton during shipping and handling of the package.

SUMMARY OF THE INVENTION

In accordance with the present invention, a package is provided which includes one or more cups, the cups arranged in an interconnected array, with the cups each having an outward projecting flange at an upper portion. The flanges are connected to define the cup array. A paperboard cover includes a polygonal main panel of an area generally corresponding to and not greater than the area of the interconnected cup flanges. The main panel is disposed over the array, and a side panel is connected along an upper fold line to each side edge of the main panel. Each of the side panels projects generally downwardly from the main panel.

Each adjacent pair of side panels is foldably connected at the respective end edges through a pair of foldably interconnected web panels. The angle defined between each end edge of the side panels and its corresponding upper fold line is less than 90 degrees. The individual web panels of each pair are attached to each other in overlapping arrangement and is disposed behind an associated one of the side panels. As a result, the side panels are tapered inwardly with respect to the cups to thereby secure the main panel to the array, and hence the cover to the cups.

In one embodiment of the invention, the main panel may be rectangular. The array may comprise a plurality of the cups arranged in equal numbers in a plurality of rows.

In another embodiment of the invention, each of the side walls may be generally of a trapezoidal shape, having long and short parallel edges therefor, the long parallel edge being coincident with the upper fold line by which the side panel is joined to the main panel.

DETAILED DESCRIPTION OF THE PREFERRED EMBODIMENTS

Figure 1:
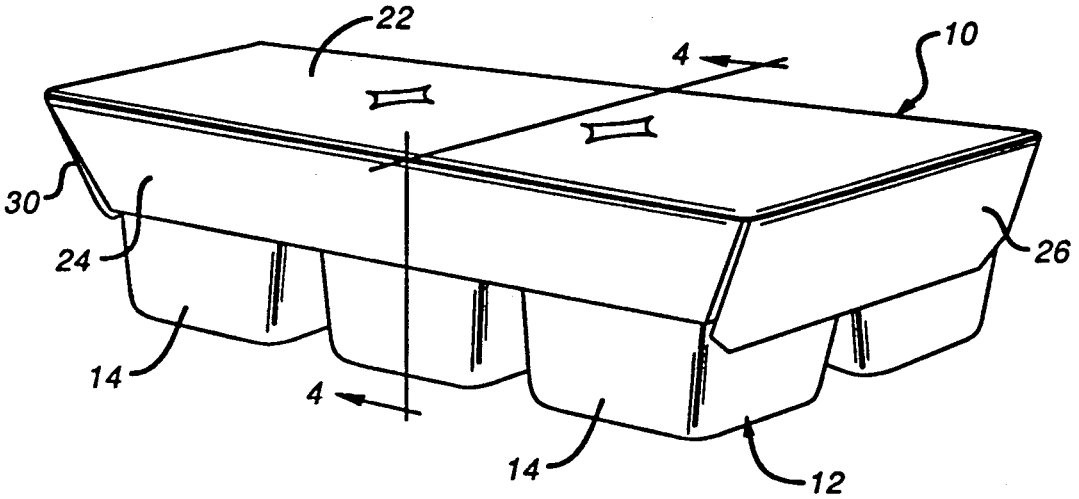
FIG. 1 is a perspective view showing the package in accordance with the present invention.

A preferred embodiment for the present invention can be seen by reference to FIG. 1. The package includes a paperboard cover 10 which is disposed over an array of interconnected cups 12.

Figure 2:
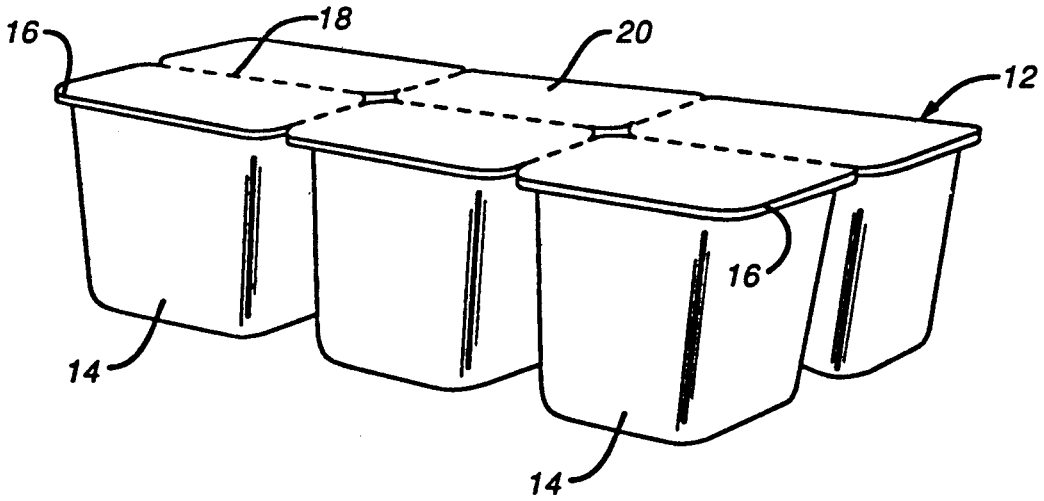
FIG. 2 is a view similar to FIG. 1, but with the paperboard cover removed, showing the array of interconnected cups incorporated into the package.

The array 12 of cups can be better seen by reference to FIG. 2, wherein the paperboard cover is shown removed. Each cup 14 includes a flange 16 which projects outwardly at the top of the cup 14. The flanges 16 of adjacent cups are interconnected to form the entire array 12 of cups. A score line 18 or similar means is defined on the interconnected flanges so that the individual cups 14 may be separated for single servings. A plastic film or metal foil cover 20 is secured in known manner to the tops of the flanges 16 to seal the contents of the cups 14.

Figure 3:
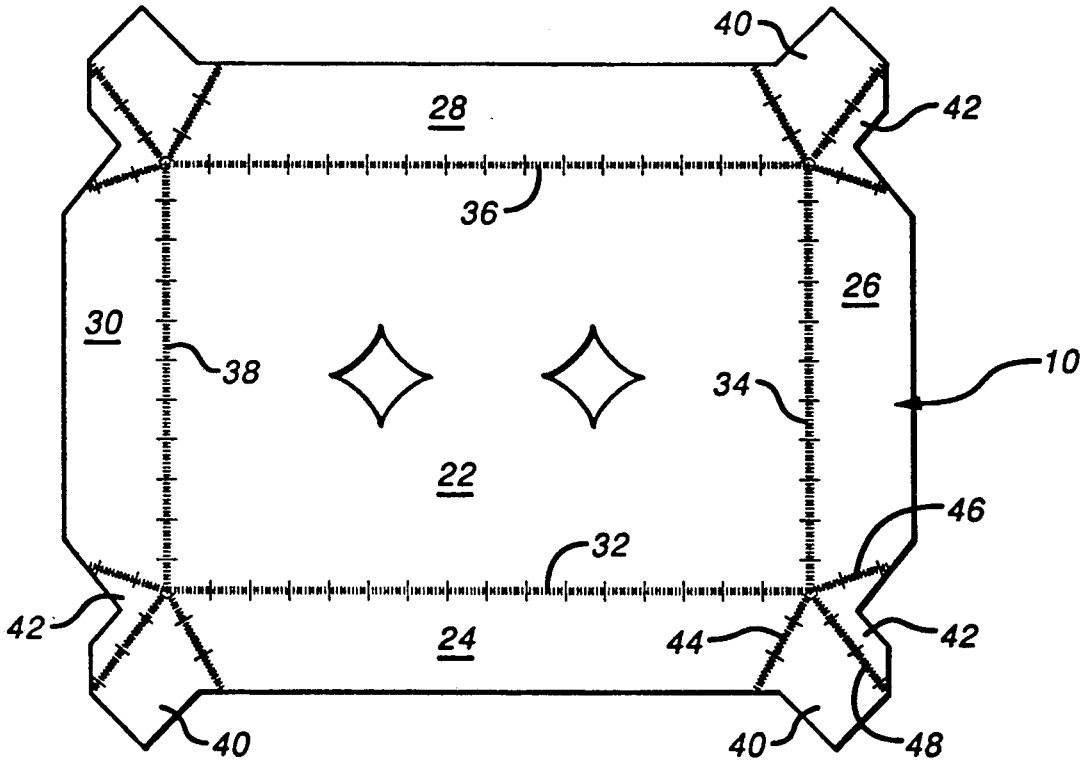
FIG. 3 is a plan view showing the blank from which the paperboard cover is formed.

The cover 10 is shown in its flat, blank form in FIG. 3. The cover 10 includes a main panel 22 which is generally polygonal and is sized to correspond generally to the area of the interconnected flanges. Particularly, the polygonal dimensions of the panel do not exceed the corresponding longest dimensions of the interconnected flanges.

In the preferred embodiment, main panel 22 is rectangular. However, those skilled in the art will appreciate that the main panel, and hence the package, may be triangular, hexagonal, or any other polygonal shape.

Connected along each edge of the main panel 22 is a side panel 24, 26, 28 and 30. Each panel 24, 26, 28 and 30 is connected to main panel 22 by a fold line 32, 34, 36 and 38, respectively. Each adjacent pair of side panels, for example side panels 24 and 26, are interconnected through a pair of web panels 40 and 42. Web panel 40 is attached along a fold line 44 to an end edge of the side panel 24, while web panel 42 is connected along a fold line to the end edge of side panel 26. The web panels 40 and 42 are themselves connected along a fold line 48.

It should be noted that the angle defined between each end edge of the side panels, and the adjacent fold line connecting the side panel to main panel 22, for example fold lines 32 and 44, is less than 90 degrees. This provides an inward taper to the side panels when erected, as will be described below.

Each side panel 24, 26, 28 and 30 is, in the preferred embodiment, generally trapezoidal in shape. The long parallel side of each trapezoid coincides with the respective fold line 32, 24, 36 or 38 joining the side panel to the main panel. Of course, it is not necessary for the side panel to be trapezoidal to fall within the present invention. For example, the free edges of the side panels may be curved or comprised of a series of interconnected straight lines.

Referring now back to FIG. 1, the cover 10 is placed over the cup array 12 by positioning main panel 22 over the interconnected flanges of the cups. Side panels 24 and 28 (the latter not shown) are folded downwardly through greater than 90°. so that the lower edges of the side panels are against or near the side walls of the cups 14. The web panels 40 and 42 (see FIG. 3) are folded into an overlapping relationship and are adhered to each other by glue or the like. It will be recognized that folding and gluing of web panels 40 and 42 will fold side panels 26 and 24 downwardly, secure them in the position shown in FIG. 1.

Figure 4:
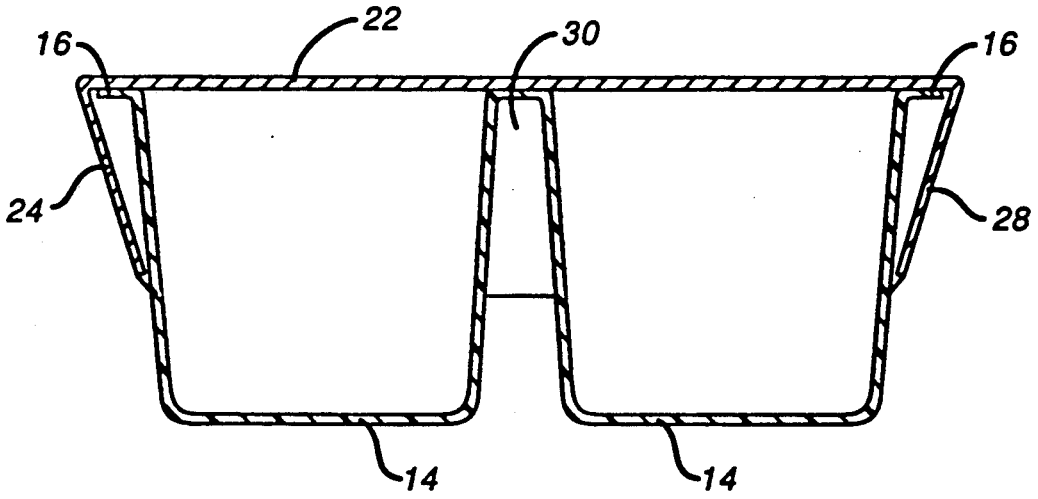
FIG. 4 is a sectional view taken generally along line 4—4 of FIG. 1.

Referring to FIG. 4, it can be seen that the side panels 24 and 28 taper inwardly with respect to the cups 14. (Side panels 26 and 30 occupy a similarly inwardly tapered position.) This captures the flanges 16 of the cups 14 between the main panel 22 and the side panels, thereby securing the cover to the cup array. It should be noted that the cover is thus attached to the cups without the need for gluing or otherwise connecting the cover directly to the cup array. The cover will then be retained throughout the distribution process, but may be easily removed by the consumer without affecting the packaged cups or particularly their sealing means.

It will be recognized that various alternate embodiments may be used within the scope of the invention. For example, the array of cups may consist of a single cup, the cup including the outwardly projecting flange. Further, while the cups are preferably formed from a molded, thermoplastic material, it is possible for the cups to be formed of other materials such as molded paperboard, formed metal, and the like. In addition, the cups may include a removable and reclosable cover in addition to the paperboard, which cover may replace or supplement the foil or plastic film secured to seal the cups.

What is claimed is:

1. A package, comprising:

at least one cup, each of said cups having an outward projecting flange at an upper portion thereof, said cups being arranged and interconnected at their respective flanges to form an array; and a paperboard cover having a polygonal main panel of an area generally corresponding to and not greater than the area of said interconnected flanges, said main panel disposed over said array, a side panel connected along an upper fold line to each side edge of said main panel, each of said side panels projecting generally downwardly from said main panel, each adjacent pair of side panels being foldably connected at their respective end edges through a pair of foldably interconnected web panels, the angle defined between each end edge of said side panels and the corresponding one of said upper fold lines being less than ninety degrees;

each of said pairs of web panels being attached together in overlapping arrangement and disposed behind an associated one of said side panels, whereby said side panels are tapered inwardly with respect to said cups to thereby secure said main panel to said array and said cover to said cups.

2. The package as defined in claim 1, wherein said main panel is rectangular.

3. The package as defined in claim 2, wherein said array comprises a plurality of said cups arranged in equal numbers in a plurality of rows.

4. The package as defined in claim 1, wherein said cups are formed of a thermoplastic material.

5. The package as defined in claim 1, wherein each of said side walls is generally of a trapezoidal shape, having long and short parallel edges therefor, said long parallel edge being coincident with said upper fold line.

* * * * *